United States Patent [19]

Watkins

[11] Patent Number: 4,957,252

[45] Date of Patent: Sep. 18, 1990

[54] SUPPORT FOR PLASTIC BAGS HAVING HANDLES

[76] Inventor: Vancil W. Watkins, 2058 Lovers La., Shreveport, La. 71105

[21] Appl. No.: 371,071

[22] Filed: Jun. 26, 1989

[51] Int. Cl.[5] ..... A63B 55/04

[52] U.S. Cl. ..... 248/97; 248/99; 248/100

[58] Field of Search ..... 248/95, 97, 98, 99, 248/100, 101, 175; 220/404, 1 T; 141/314, 391

[56] References Cited

U.S. PATENT DOCUMENTS

| | | | |
|---|---|---|---|
| 2,031,147 | 2/1936 | Doolin | 248/95 X |
| 3,695,565 | 10/1972 | Hodges | 248/97 |
| 3,870,261 | 3/1975 | McSwain | 248/98 X |
| 4,316,353 | 2/1982 | Suominen | 248/100 X |
| 4,407,474 | 10/1983 | Swenson | 248/97 |
| 4,458,867 | 7/1984 | Malik | 248/97 |
| 4,487,388 | 12/1984 | Provan | 248/97 |
| 4,620,683 | 11/1986 | Claydon et al. | 248/97 |
| 4,690,357 | 9/1987 | Webster | 248/99 |
| 4,750,694 | 6/1988 | Bateman | 248/97 |
| 4,802,647 | 2/1989 | Celamyster et al. | 248/97 X |
| 4,821,903 | 4/1989 | Hayes | 248/98 X |
| 4,840,336 | 6/1989 | Stroh et al. | 248/97 |

*Primary Examiner*—Ramon O. Ramirez
*Attorney, Agent, or Firm*—John M. Harrison

[57] ABSTRACT

A support for plastic bags having handles or carrying loops, which support is characterized by a frame having a rectangular or square base, a pair of vertical members rigidly upward-standing from the base and a bag retainer supported by the vertical members parallel to and spaced from the base. A pair of bag handle retainers are provided on the vertical members and an optional lid 15 may be hinged to the bag retainer. The support is designed to receive plastic shopping bags provided with integral, oppositely-disposed handles, such that the bag pouch is inserted through the bag retainer and over the base, with the handles folded over opposite sides of the bag retainer and extended into engagement with the oppositely-disposed bag handle retainers. The optional lid may then be closed over the top or mouth of the bag, as desired.

11 Claims, 1 Drawing Sheet

FIG. 1
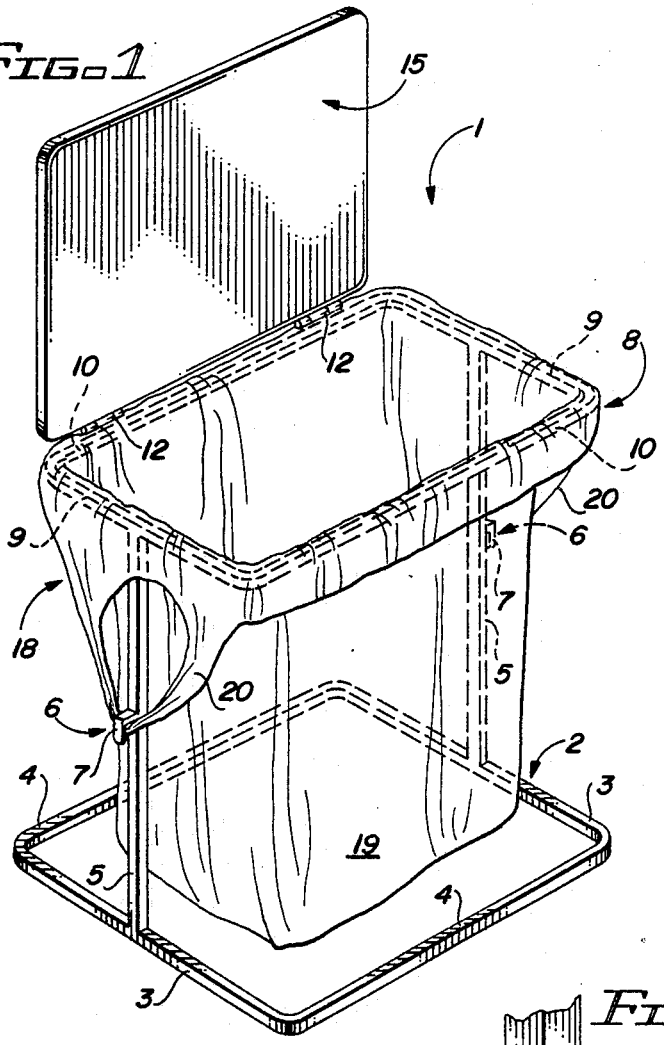
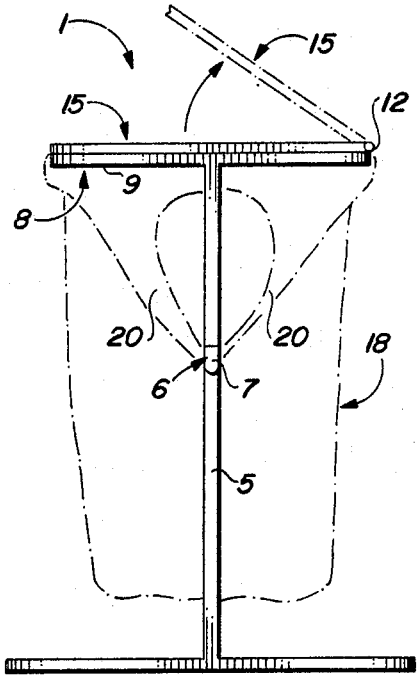
FIG. 2
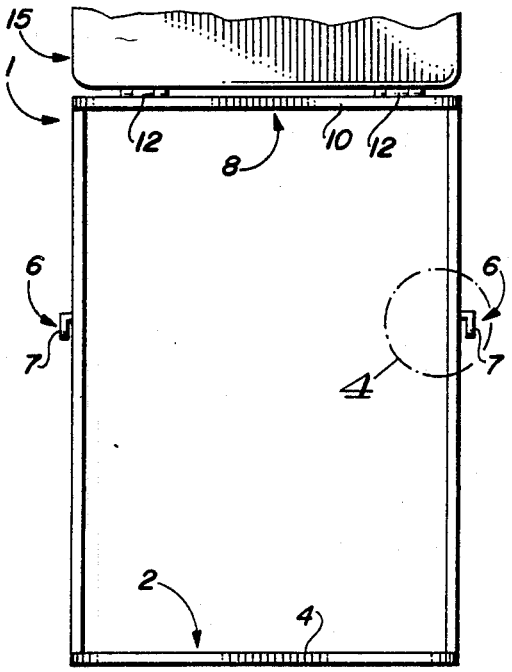
FIG. 3
FIG. 4
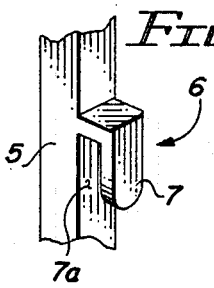
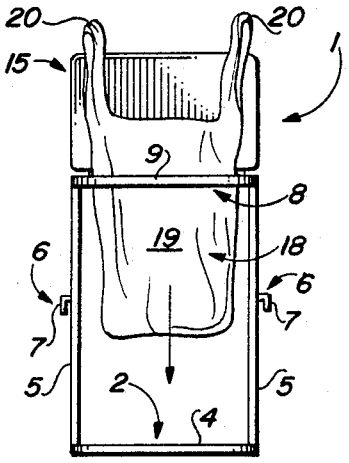
FIG. 5A
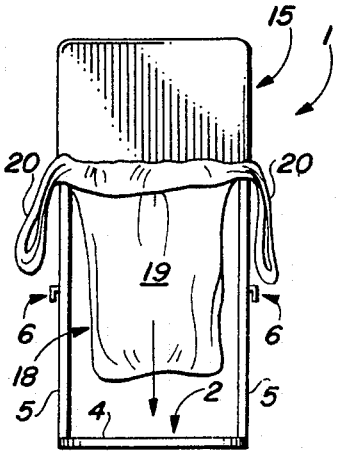
FIG. 5B
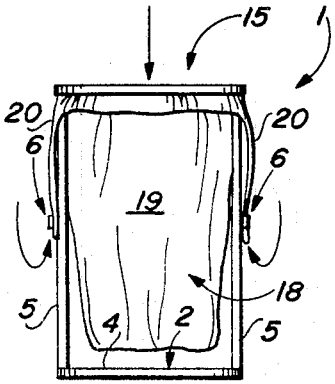
FIG. 5C

SUPPORT FOR PLASTIC BAGS HAVING HANDLES

BACKGROUND OF THE INVENTION

1. Field of the Invention

This invention relates to holders and containers for plastic trash bags and more particularly, to a support for plastic bags having flexible loops or handles, which support is characterized by a pair of bag handle retainers located on a frame for receiving the handles of the plastic bags and retaining the plastic bags, one-by-one, in the frame. In a preferred embodiment of the invention the support is constructed of plastic, metal or fiberglass material and is characterized by a square or rectangular base fitted with spaced, rigid, upward-standing vertical members and a rectangular bag retainer supported by the vertical members parallel to and spaced from the base, with downwardly-extending bag handle retainers provided on the vertical members. The pouch of a plastic shopping bag having oppositely-disposed, flexible plastic handles is inserted in the bag retainer, with the flexible bag handles folded outwardly over the bag retainer and downwardly into engagement with the bag handle retainers, respectively, in order to secure the bag in the support. An optional lid may be hinged to the bag retainer for closing the mouth of the bag and the support and controlling odor, as desired.

While brown paper shopping bags of various size have long been used by grocery stores and other business enterprises for packing groceries and merchandise, in recent years plastic shopping bags have seen increasing use in this capacity. These plastic shopping bags are shallow and are commonly designed with a bag pouch having oppositely-disposed, integral plastic handles at the top or mouth, for carrying the bag. The bags are sometimes used in garbage cans and trash receptacles as liners. However, a problem which is sometimes realized in the use of such plastic bags in this capacity is the propensity of the bags to slide inwardly of the carrying receptacle and collapse when filled with garbage or trash. Other trash bags which are larger and deeper and are designed without the resilient carrying handles are normally placed in a garbage receptacle or trash container with the top of the bag folded over the edges of the container to retain the bag in place. However, the plastic shopping bags having such handles are normally not sufficiently deep to facilitate folding the top edge and the handles over the edge of most containers, which are deeper than the shopping bag, a factor which further complicates the problem of stabilizing such bags in a trash or garbage container.

2. Description of the Prior Art

Various types of garbage bag holders and trash container receptacles are known in the art. Typical of these devices is the "Plastic Garbage Bag Holder and Sealer" detailed in U.S. Pat. No. 3,695,565, dated Oct. 3, 1972, to John Hodges. The patent details a holder for plastic garbage bags, which holder is capable of constantly retaining the mouth of the bag in the "open" and "closed" positions by resistance friction, but is also capable of permitting the bag to be disposed such that the mouth appears to be displayed in "open" configuration and optionally in "closed" configuration, although the mouth remains open. A "Plastic Sack Holder" is detailed in U.S. Pat. No. 4,407,474, dated Oct 4, 1983, to Rita Swenson. The Swenson patent describes a device designed to hold a limp plastic sack open for loading purposes. The sack is characterized by a body portion terminating in a base and having a pair of integrally-formed handles. The device for supporting the sack includes a horizontally-disposed base member, a pair of oppositely-disposed, upwardly-projecting side wall members, each of which is attached at its lower end to the base member, an upwardly-projecting rear wall member designed such that each vertical edge of the rear wall member is attached to a vertical edge of each of the side wall members and further including means at the top of the device for engaging the handles of the plastic sack. U.S. Pat. No. 4,458,867, dated July 10, 1984, to James J. Malik, details a "Wire Rack Bag Holding Device". The device is designed for holding a plastic bag open so that it can be filled, and is constructed from wire stock, essentially without welds. The plastic bag is characterized by integral handle loops which are held apart in the rack. The wire rack includes left and right swing panels, each formed from a single length of wire stock, a spacer frame which includes plural, parallel wire members having wrap-around ends that are wrapped around the upper portions of each panel, and a base support which connects the panels and receives the base of the bag. Each swing panel includes a tab-shaped, horizontal upper portion to engage a handle loop of the plastic bag and hold it open. U.S. Pat. No. 4,487,388, dated Dec. 11, 1984, to Alexander R. Provan, details a "Holder for Facilitating Loading of Plastic Bags". The holder is designed to carry bags having an open mouth and upwardly-extending handle loops, which loops are placed on spaced tabs located in the holder. When the bag is loaded, the loaded bag is removed from the holder by lifting the loops from the tabs. The holder avoids the use of welds at points where it is subjected to twisting or rocking forces. U.S. Pat. No. 4,620,683, dated Nov. 4, 1986, to Susan D. Claydon, et al, details an "Apparatus for Supporting a Flexible Container in an Open Position". The support structure is designed to contain plastic shopping bags and is both collapsible for storage and readily assembled to support the flexible container in an open position for the placement of items therein. A "Bag Stand Container" is detailed in U.S. Pat. No. 4,690,357, dated Sept. 1, 1987, to James N. Webster. The device is characterized by a free-standing frame and lid assembly for supporting plastic garbage bags during filling. The stand includes a metal frame having a top rectangular section, over which the opening of the plastic bag may be stretched, a similar bottom rectangular section which rests on the floor and two vertical legs rigidly connected to the sections by a continuation of the same material. A lid is hinged to one side of the top rectangular section of the frame by a circular clip attached to the lid. The continuity of the material and the connections of the top and bottom sections to the legs provide rigidity to the frame and the stretched portion of the bag disposed over the frame opening forms an effective seal with the attached lid in place. "A Trash Bag Holder" is detailed in U.S. Pat. No. 4,802,647, dated Feb. 7, 1989, to James M. Celmayster, et al. The trash bag holder is designed for holding a loop-handle trash bag and includes a pair of inverted, U-shaped supports which are supported by a pair of elongated bases. Each support includes a pair of vertical legs and an upper connecting portion that extends between the legs. Upper bight portions of the legs and ends of each connecting portion cooperate to define notches that receive the looped handles in the trash bag to secure the bag handles in place. Lower distal ends of the support legs are received within connection holes in the base ends, such that the bases extend in spaced and parallel relationship to each other, to facilitate use of the holder on unobstructed floor spaces. The supports are preferably constructed from bent metal wire, while the bases are preferably manufactured from injection-molded plastics.

It is an object of this invention to provide a new and improved support for plastic bags having handles, which support is characterized by a base member, vertical members upward-standing from the base member, bag handle retainers located on the vertical members, respectively, and a bag retainer attached to the extending ends of the vertical members and spaced from the bag handle retainers, for receiving a plastic bag, with the handles of the bag engaging the bag handle retainers, in order to maintain the bag in position in the support.

Another object of the invention is to provide a new and improved support for receiving and supporting plastic bags having integral handle loops, which support includes a square or rectangular base member, a pair of upwardstanding, rigid vertical members attached to or integrally formed with the base member, a pair of bag handle retainers attached to the vertical members, a rectangular top retainer member supported by the vertical members and spaced from the base member, wherein the bag pouch is inserted in the top retainer member and the bag handle retainers receive and support the integral handle loops of the bag to maintain the bag in position in the support, and further including a lid hinged to the top retainer member for closing the bag.

Yet another object of this invention is to provide a bag support for supporting a plastic bag having oppositely-disposed, integral, flexible handle loops, which bag support is characterized by a base of selected size and shape, a pair of spaced, rigid, vertical members upward-standing from fixed attachment to the base, a bag retainer having a configuration corresponding to the shape of the base and attached to the vertical supports in spaced relationship with respect to the base for receiving the pouch of a plastic bag, and a pair of bag handle retainers secured to the mid-portions of the vertical members and fitted with downwardly-extending cleats for receiving and removably retaining the handle loops of the bag.

SUMMARY OF THE INVENTION

These and other objects of the invention are provided in a support for a plastic bag having integral handle loops, which support includes a base member shaped in the configuration of a polygon, a pair of rigid vertical supports extending from the base member with downwardly-projecting bag handle retainers cleats located on the vertical supports and a rectangular-shaped bag retainer supported by the supports in spaced, parallel relationship with respect to the base member for receiving a plastic bag, with the integral handle loops engaging the bag handle retainers to maintain the bag pouch in the support. A lid may be hinged to the bag retainer for closing the mouth of the plastic bag.

BRIEF DESCRIPTION OF THE DRAWING

The invention will be better understood by reference to the accompanying drawing, wherein:

FIG. 1 is a perspective view of a preferred embodiment of the support of this invention, with the optional lid open and a plastic bag having handles disposed in the support in functional configuration;

FIG. 2 is a side view of the support illustrated in FIG. 1, with the lid in closed configuration and the plastic bag illustrated in phantom;

FIG. 3 is a front view of the support illustrated in FIG. 1 with the plastic bag removed;

FIG. 4 is a perspective sectional view of a preferred bag handle retainer defined by a cleat and cleat slot for securing each bag handle in the support;

FIG. 5A is a front view of the support illustrated in FIG. 1, with a plastic bag partially inserted in the support;

FIG. 5B is a front view of the support illustrated in FIG. 5A, with the handle loops folded over the bag retainer and turned downwardly toward the bag handle retainers, and FIG. 5C is a front view of the support illustrated in FIGS. 5A and 5B, with the handle loops attached to the bag handle retainers and the plastic bag seated in the support in functional configuration.

DESCRIPTION OF THE PREFERRED EMBODIMENTS

Referring initially to FIGS. 1–4 of the drawing, the support of this invention is generally illustrated by reference numeral 1 and includes a rectangular base 2, defined by parallel base sides 3, and parallel base side connectors 4, which join the base sides 3. In a most preferred embodiment of the invention, the base sides 3 and the base side connectors 4 are shaped from a single, elongated, metal, plastic or fiberglass element which is joined at the ends by a weld, cement or other appropriate means. A pair of oppositely-disposed, rigid vertical members 5 extend upwardly from fixed attachment to the centers of the base sides 3 and a rectangular bag retainer 8 is supported by the vertical members 5 in substantially parallel relationship with respect to the base 2. The bag retainer 8 is further characterized by a pair of bag retainer sides 9, which are located in parallel, spaced relationship with respect to the base sides 3 of the base 2 and a pair of retainer side connectors 10, which connect the bag retainer sides 9 and are disposed parallel to and in spaced relationship with respect to the corresponding base side connectors 4 of the base 2. As in the case of the base 2, the bag retainer sides 9 and the retainer side connectors 10 are preferably constructed of a single element of metal, fiberglass, plastic or similar material which is joined at the ends by welding or other means. Similarly, the ends of the vertical members 5 are connected to the base sides 3 and the bag retainer sides 9, respectively, by means of welds, glue or other attachment means. Alternatively, the base 2, vertical members 5 and bag retainer 8 can be constructed and shaped from a single piece of material, such as an elongated wire or rod of sufficient structural integrity, according to the knowledge of those skilled in the art. As illustrated in FIGS. 1 and 4, a pair of bag handle retainers 6, defined by downwardly-extending cleats 7 and cleat slots **7*a*, are disposed on the vertical members 5 approximately midway between the base 2 and the bag retainer 8. An optional lid 15 is hingedly attached to one of the retainer side connectors 10 by a pair of hinges 12, to facilitate opening and closing of the lid 15 on the bag retainer 8, as illustrated in FIGS. 1 and 3. In a preferred embodiment of the invention, when the lid 15 is closed on the bag retainer 8, the lid margin 16 overlaps both the bag retainer sides 9 and the retainer side connectors 10, as further illustrated in FIG. 1**.

Referring now to FIGS. 1, 2 and 5A–5C of the drawing, a plastic bag 18, having integral bag handles 20, is placed in the support 1 by initially extending the bag pouch 19 through the bag retainer 8 and above the base 2, as illustrated in FIG. 5A, and subsequently looping the flexible bag handles 20 over the bag retainer 8 and downwardly, toward the spaced, downwardly-extending bag handle retainers 6, as illustrated in FIG. 5B. The bag handles 20 are then looped around the cleats 7 and inserted in the cleat slots *7a* of the bag handle retainers 6, respectively, and the bag handle retainers 6 serve to secure the bag handles 20 and maintain the bag pouch 19 in the desired configuration inside the support 1 and the mouth of the bag in open configuration to receive trash or garbage without collapsing the plastic bag 18, as illustrated in FIG. 5C. When the plastic bag 18 is installed in the configuration illustrated in FIGS. 1 and 5C, the lid 15 can be closed over the mouth of the plastic bag 18 on the bag retainer 8 to seal undesirable odor from the trash or garbage located in the plastic bag 18.

It will be appreciated by those skilled in the art that the base 2, vertical members 5 and the bag retainer 8 of the support 1 can be constructed of substantially any material having sufficient structural integrity to support the plastic bag 18 and the contents thereof. For example, the base sides 3 and the base side connectors 4 of the base 2, as well as the bag retainer sides 9 and the retainer side connectors 10 of the bag retainer 8, can be constructed of metal tube, rod or bar stock or these elements may be constructed of injection-molded plastic or fiberglass, in non-exclusive particular, as desired. Furthermore, the outwardly and downwardly-extending cleats 7 in the bag handle retainers 6 can be welded or otherwise attached to the respective vertical members 5, for removably receiving the flexible bag handles 20 of the plastic bag 18. Moreover, the base 2 and bag retainer 8 of the support 1 can be constructed in any desired configuration, including polygonal, round, oval, elliptical or the like, in non-exclusive particular, and then painted in any desired color. In a most preferred embodiment of the invention, the base 2 is rectangular in shape and is larger than the bag retainer 8, in order to further stabilize the support 1, especially when the bag pouch 19 of the plastic bag 18 is filled with trash or garbage.

It will be further appreciated by those skilled in the art that a primary feature of the support 1 is the outwardly and downwardly-extending cleats 7 in the bag handle retainers 6, which project from the vertical members 5 in spaced relationship with respect to the bag retainer 8, and preferably, from about one-third to approximately mid-way between the base 2 and the bag retainer 8, measured from the bag retainer 8, in order to receive and anchor the bag handles 20 of the plastic bag 18. Other attempts to anchor and retain the bag handles 20 have resulted in more complicated mechanisms for accomplishing this goal and the support 1 of this invention is characterized by simplicity and ease of installation and removal of the plastic bag 18, because of the simplicity of engaging the bag handles 20 with the conveniently located bag handle retainers 6.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A support for a plastic bag having integral handles, said support comprising a base characterized by a rigid, elongated base member shaped substantially in the configuration of a polygon; a pair of rigid, elongated vertical members upward-standing from fixed attachment to said base in spaced relationship; a rigid, elongated bag retainer shaped substantially in the configuration of a rectangle, said bag retainer fixedly supported by said vertical members in spaced relationship with respect to said base for receiving the plastic bag; and a pair of downwardly-extending cleats carried by said vertical members, respectively, said cleats located between said bag retainer and said base member for receiving the handles and supporting the plastic bag on said bag retainer.

2. The support of claim 1 wherein said cleats are located on said vertical members about midway between said bag retainer means and said base.

3. The support of claim 1 further comprising a lid hingedly carried by said bag retainer for selectively closing the plastic bag when the plastic bag is inserted in said support.

4. The support of claim 1 wherein said cleats are located on said vertical members about midway between said bag retainer and said base and further comprising a lid hingedly carried by said bag retainer for selectively closing the plastic bag when the plastic bag is inserted in said support.

5. The support of claim 1 wherein said polygon further comprises a rectangle.

6. The support of claim 5 further comprising a lid hingedly carried by said bag retainer for selectively closing the plastic bag when the plastic bag is inserted in said support and wherein said cleats are located on said vertical members about midway between said bag retainer and said base.

7. The support of claim 6 wherein said base is larger than said bag retainer.

8. A support for a plastic bag having integral handles, said support comprising a base characterized by a rigid, elongated base member shaped substantially in the configuration of a rectangle; a pair of rigid, elongated vertical members upward-standing from fixed attachment to said base member in spaced relationship; a rigid, elongated bag retainer shaped substantially in the configuration of a rectangle, said bag retainer fixedly supported by said vertical members in spaced relationship with respect to said base member for receiving the plastic bag; a pair of downwardly-extending cleats carried by said vertical members, respectively, said cleats located between said bag retainer and said base member for receiving the handles and supporting the plastic bag on said bag retainer; and a lid hingedly carried by said bag retainer for selectively closing the plastic bag when the plastic bag is inserted in said support.

9. The support of claim 8 wherein said cleats are located on said vertical members about midway between said bag retainer and said base.

10. The support of claim 8 wherein said base is larger than said bag retainer.

11. The support of claim 8 wherein:

(a) said cleats are located on said vertical members about midway between said bag retainer and said base; and (b) said base is larger than said bag retainer.

* * * * *